US008118553B2

(12) United States Patent
Liang

(10) Patent No.: US 8,118,553 B2
(45) Date of Patent: Feb. 21, 2012

(54) TURBINE AIRFOIL COOLING SYSTEM WITH DUAL SERPENTINE COOLING CHAMBERS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 393 days.

(21) Appl. No.: 12/407,914

(22) Filed: Mar. 20, 2009

(65) Prior Publication Data

US 2010/0239431 A1 Sep. 23, 2010

(51) Int. Cl.
*B63H 3/00* (2006.01)

(52) U.S. Cl. ..... 416/96 R; 416/97 R; 415/115

(58) Field of Classification Search ..... 416/96 R, 416/97 R; 415/115, 116
See application file for complete search history.

(56) References Cited

U.S. PATENT DOCUMENTS

| | | | | |
|---|---|---|---|---|
| 3,849,025 | A | 11/1974 | Grondahl | |
| 4,820,123 | A | 4/1989 | Hall | |
| 5,397,217 | A * | 3/1995 | DeMarche et al. | 416/97 R |
| 5,591,007 | A | 1/1997 | Lee et al. | |
| 5,873,695 | A * | 2/1999 | Takeishi et al. | 415/115 |
| 5,902,093 | A * | 5/1999 | Liotta et al. | 416/97 R |
| 5,967,752 | A | 10/1999 | Lee et al. | |
| 5,997,251 | A | 12/1999 | Lee | |
| 6,186,741 | B1 * | 2/2001 | Webb et al. | 416/96 R |
| 6,220,817 | B1 * | 4/2001 | Durgin et al. | 416/97 R |
| 6,290,463 | B1 * | 9/2001 | Fargher et al. | 416/97 R |
| 7,008,186 | B2 | 3/2006 | Heeg et al. | |
| 7,270,517 | B2 | 9/2007 | Garner | |
| 7,296,972 | B2 * | 11/2007 | Liang | 416/97 R |
| 7,300,250 | B2 | 11/2007 | Papple | |
| 7,413,403 | B2 | 8/2008 | Cunha et al. | |
| 2006/0222493 | A1 * | 10/2006 | Liang | 416/97 R |
| 2008/0101961 | A1 | 5/2008 | Liang et al. | |
| 2008/0159874 | A1 | 7/2008 | Pietraszkiewicz et al. | |

FOREIGN PATENT DOCUMENTS

EP 0916811 A2 5/1999

* cited by examiner

*Primary Examiner* — Kiesha Bryant
*Assistant Examiner* — Mark Tornow

(57) ABSTRACT

A cooling system for a turbine airfoil of a turbine engine having dual serpentine cooling channels, an inward serpentine cooling channel and an outward serpentine cooling channel, positioned within the airfoil. The inward serpentine cooling channel may receive cooling fluids from a cooling supply system through the root and exhaust cooling fluids to the outward serpentine cooling channel at the leading edge. The outward serpentine cooling channel may pass the cooling fluids through the outward portion of the serpentine cooling channel and exhaust the cooling fluids through the trailing edge of the airfoil. Such configuration yields a better creep capability for the blade.

15 Claims, 2 Drawing Sheets

TURBINE AIRFOIL COOLING SYSTEM WITH DUAL SERPENTINE COOLING CHAMBERS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for a cooling system capable of providing sufficient cooling to turbine airfoils.

SUMMARY OF THE INVENTION

This invention relates to a turbine airfoil cooling system for a turbine airfoil used in turbine engines. In particular, the turbine airfoil cooling system includes a plurality of internal cavities positioned between outer walls of the turbine airfoil. The cooling system may include an inward serpentine cooling channel and an outward serpentine cooling channel within interior aspects of the airfoil. The inward and outward serpentine cooling channels form dual cooling channels. The dual cooling channels are configured to first pass cooling fluids through the inward serpentine cooling channel proximate a root of the airfoil and then to the outward serpentine cooling channel. This configuration partitions the airfoil in half and preheats the cooling fluid for the outward serpentine cooling channel and yields a better creep capability for the airfoil.

The turbine airfoil may be formed from a generally elongated, hollow airfoil having a leading edge, a trailing edge, a tip at a first end, a root coupled to the airfoil at an end generally opposite to the first end for supporting the airfoil and for coupling the airfoil to a disc, and a cooling system formed from at least one cavity in the elongated, hollow airfoil. An outer wall may form an outer surface of the generally elongated airfoil. The cooling system may be formed from dual serpentine cooling channels comprising a radially inward serpentine cooling channel of the cooling system that is formed from a winding channel with portions extending in a spanwise direction between the root and a point between the root and the tip. A radially outward serpentine cooling channel of the cooling system may be formed from a winding channel with portions extending in a spanwise direction between the tip and the point between the root and the tip.

In one embodiment, the radially inward serpentine cooling channel may be a triple pass channel. The radially inward serpentine cooling channel may be formed from an outward bound first pass, an inward bound second pass, and an outward bound third pass. The first and second passes may be separated by a rib extending from the root toward the tip and terminating before reaching the center rib and the second and third passes may be separated by a leading edge rib extending spanwise from proximate an intersection between the generally elongated airfoil and the root toward the tip and terminating before reaching the tip. The radially inward serpentine cooling channel may include an inlet at the intersection of the root and the trailing edge, may be directed radially inwardly to receive cooling fluids from aspects of the cooling system positioned within the root and may include an outlet at the leading edge. A first pass of the radially inward serpentine cooling channel may include a plurality of metering slots positioned in the trailing edge. A plurality of pin fins may extend between the outer wall forming the pressure side and the outer wall forming the suction side in the radially inward serpentine cooling channel. The radially inward serpentine cooling channel and the radially outward serpentine cooling channel may be separated from each other by a center rib extending generally chordwise.

The radially outward serpentine cooling channel may be formed from an outward bound first pass, an inward bound second pass, and an outward bound third pass, wherein the first and second passes are separated by the leading edge rib and wherein the second and third passes are separated by a rib extending spanwise from the tip inward toward the center rib and terminating before contacting the center rib. The radially outward serpentine cooling channel may include an inlet in communication with the outlet of the radially inward serpentine cooling channel at the leading edge and may include at least one outlet at the trailing edge to exhaust the cooling fluids. The outlet at the trailing edge may be formed from a plurality of metering slots positioned in the trailing edge. A plurality of protrusions forming trip strips may extend from the outer wall forming the pressure side and from the outer wall forming the suction side in the radially outward serpentine cooling channel.

An advantage of this invention is that the airfoil is partitioned with dual serpentine cooling channels that allows for re-circulated heated cooling air from the inward serpentine cooling channel to be routed to the outward serpentine cooling channel.

Another advantage of this invention is that the serpentine cooling channels yield higher cooling effectiveness levels than conventionally drilled radial hole cooling designs.

Yet another advantage of this invention is that the triple pass serpentine cooling channels yields a lower and more uniform blade sectional mass average temperature for the blade lower span, which improves blade creep life capability.

Another advantage of this invention is that the inward, forward flowing, serpentine cooling channel includes a trailing edge feed and provides cooling fluids for the airfoil root section, which improves airfoil high cycle fatigue (HCF).

Still another advantage of this invention is that the turbine vane cooling channel provides cooling for the airfoil thin section, thereby improving the airfoil oxidation capability which allows for a higher operating temperature for future engine upgrades and increased cooling loads.

Another advantage of this invention is that the use of cooling fluid for cooling the inward span first and then cooling the outward span allows for the temperature of the outer wall forming the airfoil to be maintained within the allowable temperature.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
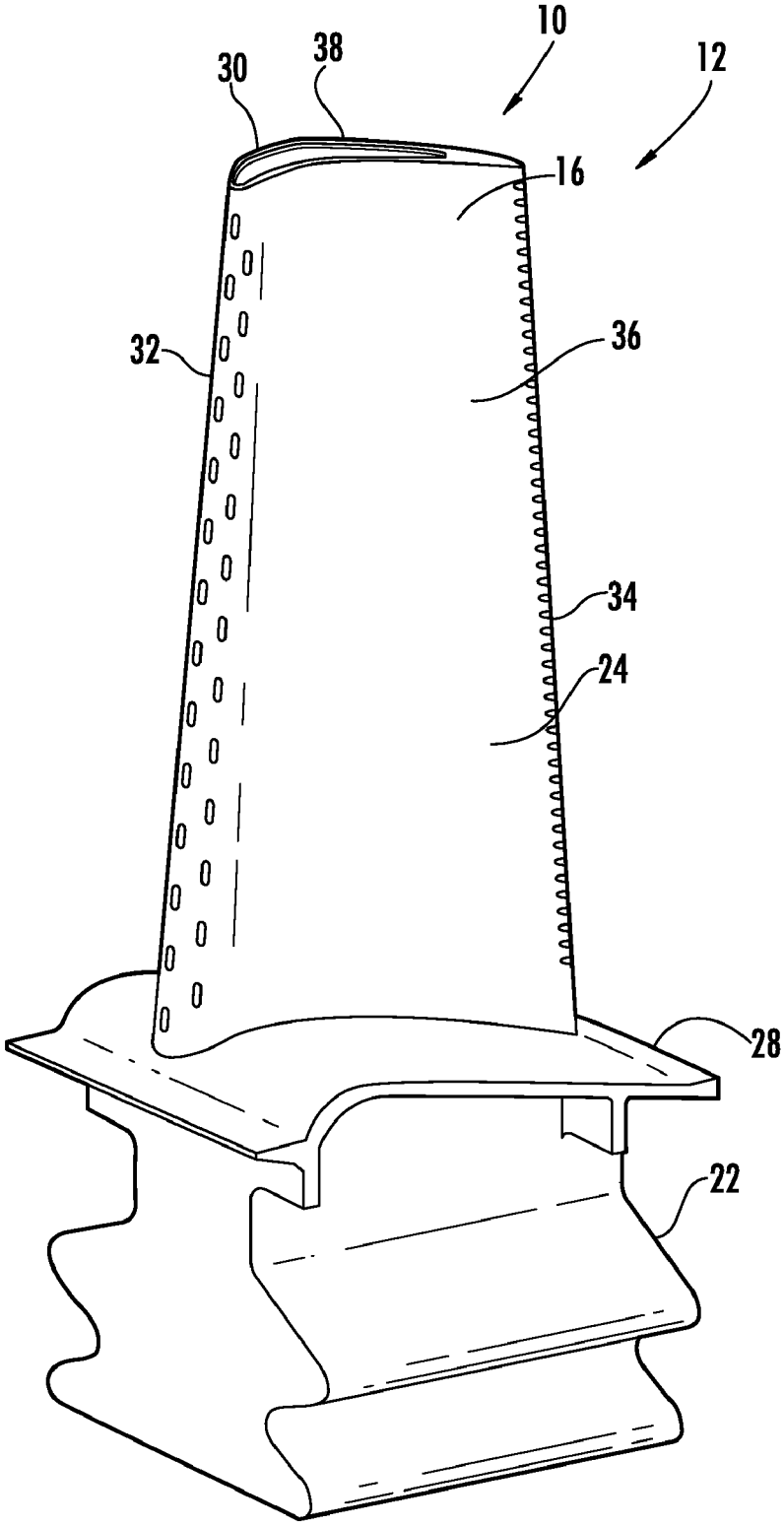
FIG. 1 is a perspective view of a turbine airfoil having features according to the instant invention.
Figure 2:
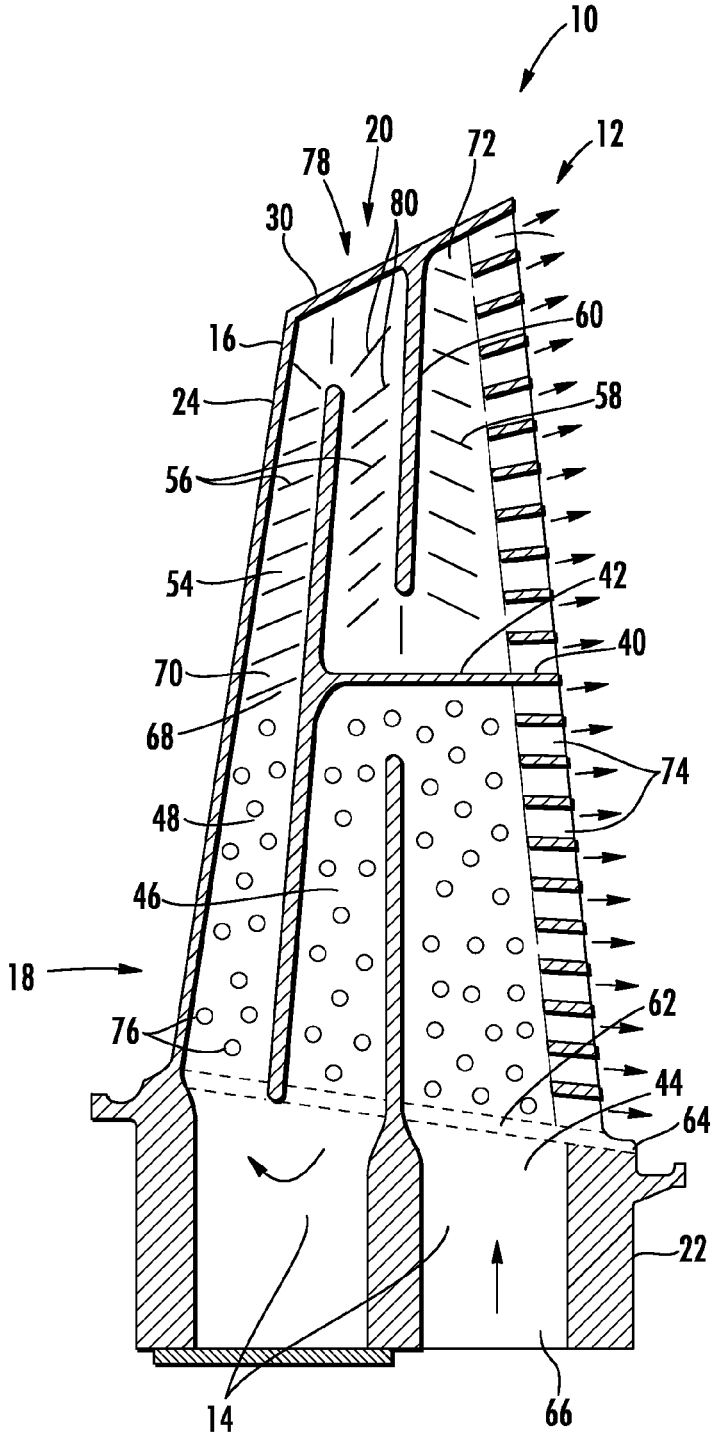
FIG. 2 is a cross-sectional view of the turbine airfoil, also referred to as a filleted view, shown in FIG. 1 taken along line 2-2.
Figure 3:
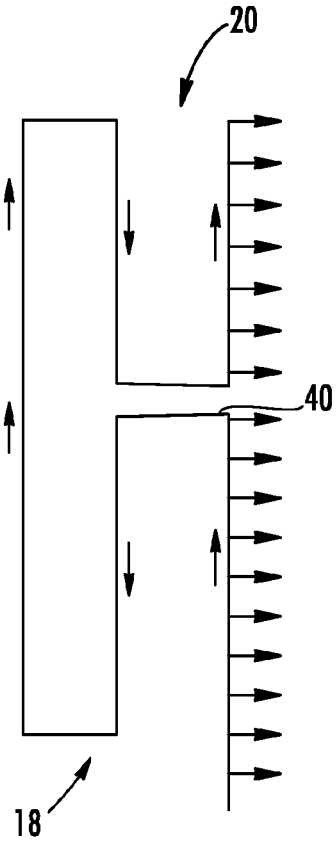
FIG. 3 is a schematic diagram of the cooling fluid flow through the turbine airfoil.

As shown in FIGS. 1-3, this invention is directed to a turbine airfoil cooling system 10 for a turbine airfoil 12 used in turbine engines. In particular, the turbine airfoil cooling system 10 includes a plurality of internal cavities 14, as shown in FIG. 2, positioned between outer walls 16 of the turbine airfoil 12. The cooling system 10 may include an inward serpentine cooling channel 18 and an outward serpentine cooling channel 20 within interior aspects of the airfoil 12. The inward and outward serpentine cooling channels 18, 20 form dual cooling channels. The dual cooling channels are configured to first pass cooling fluids through the inward serpentine cooling channel proximate a root 22 of the airfoil 12 and then to the outward serpentine cooling channel 20. This configuration partitions the airfoil 12 in half and preheats the cooling fluid for the outward serpentine cooling channel 20 and yields a better creep capability for the airfoil 12.

The turbine airfoil 12 may be formed from a generally elongated, hollow airfoil 24 coupled to a root 22 at a platform 28. The turbine airfoil 12 may be formed from conventional metals or other acceptable materials. The generally elongated airfoil 24 may extend from the root 22 to a tip 30 and include a leading edge 32 and trailing edge 34. Airfoil 24 may have an outer wall 16 adapted for use, for example, in a first stage of an axial flow turbine engine. Outer wall 16 may form a generally concave shaped portion forming pressure side 36 and may form a generally convex shaped portion forming suction side 38.

As shown in FIG. 2, the cooling system 10 may be formed from dual serpentine cooling channels 18, 20 comprising a radially inward serpentine cooling channel 18 of the cooling system 10 that is formed from a winding channel with portions extending in a spanwise direction between the root 22 and a point 40 between the root 22 and the tip 30 and a radially outward serpentine cooling channel 20 of the cooling system 10 that is formed from a winding channel with portions extending in a spanwise direction between the tip 30 and the point 40 between the root 22 and the tip 30. The inward serpentine cooling channel 18 may be separated from the outward serpentine cooling channel 20 by a center rib 42 extending generally chordwise. The inward serpentine cooling channel 18 may be a forward flowing cooling channel, and the outward serpentine cooling channel 20 may be an aft flowing cooling channel.

In at least one embodiment, the radially inward serpentine cooling channel 18 may be formed from a triple pass channel. In particular, the radially inward serpentine cooling channel 18 may be formed from an outward bound first pass 44, an inward bound second pass 46, and an outward bound third pass 48. The first and second passes 44, 46 may be separated by a rib 50 extending from the root 22 toward the tip 30 and terminating before reaching the center rib 42. The second and third passes 46, 48 may be separated by a leading edge rib 52 extending spanwise from proximate an intersection between the generally elongated airfoil 24 and the root 22 toward the tip 30 and terminating before reaching the tip 30.

The radially outward serpentine cooling channel 20 may also be formed from a triple pass channel. In particular, the radially outward serpentine cooling channel 20 may be formed from an outward bound first pass 54, an inward bound second pass 56, and an outward bound third pass 58. The first and second passes 54, 56 may be separated by the leading edge rib 52. The second and third passes 56, 58 may be separated by a rib 60 extending spanwise from the tip 30 inward toward the center rib 42 and terminating before contacting the center rib 42.

The radially inward serpentine cooling channel 18 may include an inlet 62 at the intersection 64 of the root 22 and the trailing edge 34 and is directed radially inwardly to receive cooling fluids from a channel 66 of the cooling system 10 positioned within the root 22 and includes an outlet 68 at the leading edge 32. Similarly, the radially outward serpentine cooling channel 20 may include an inlet 70 in communication with the outlet 68 of the radially inward serpentine cooling channel 18 at the leading edge 32 and includes one or more outlets 72 at the trailing edge 34 to exhaust the cooling fluids.

The first pass 44 of the radially inward serpentine cooling channel 18 may include a plurality of metering slots 74 positioned in the trailing edge 34. Likewise, the outlet 72 at the trailing edge 34 may be formed from a plurality of metering slots 74 positioned in the trailing edge 34. The metering slots 74 may be sized accordingly.

A plurality of pin fins 76 may extend between the outer wall 16 forming the pressure side 36 and the outer wall 16 forming the suction side 38 in the radially inward serpentine cooling channel 18. The pin fins 76 may included in the inward serpentine cooling channel 18 to reduce the amount of cross-sectional area to increase the velocity of the cooling fluid. Increasing the velocity of the cooling fluids increases the internal heat transfer coefficient.

The outward serpentine cooling channel 20 may include a plurality of protrusions 78 forming trip strips 80 extending from the outer wall 16 forming the pressure side 36 and from the outer wall 16 forming the suction side 38 in the radially outward serpentine cooling channel 20. The trip strips 80 are used rather than the pin fins because the outer span of the airfoil 24 is relatively thin, which may reduce casting yields. Thus, the trip strips 80 are used to increase the internal heat transfer efficiency of the outward serpentine cooling channel 20.

During use, cooling fluids may flow into the cooling system 10 from a cooling fluid supply source through the inlet 62 of the channel 66. The cooling fluids may flow into the inward serpentine channel 18 and impinge on pin fins 76 positioned within the first, second and third passes 44, 46 and 48. A portion of the cooling fluids may be exhausted through the metering slots 74 in the first pass 44. The cooling fluids may be exhausted from the outlet 68 of the inward serpentine cooling channel 18 into the inlet 70 of the outward serpentine cooling channel 20. The cooling fluids may then pass through the first, second and third passes 54, 56 and 58. The cooling fluids may be exhausted through the exhaust orifices in the third pass 58.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil having a leading edge, a trailing edge, a tip at a first end, a root coupled to the airfoil at an end generally opposite to the first end for supporting the airfoil and for coupling the airfoil to a disc, and a cooling system formed from at least one cavity in the elongated, hollow airfoil;

an outer wall forming an outer surface of the generally elongated airfoil;

wherein the cooling system is formed from dual serpentine cooling channels comprising a radially inward serpentine cooling channel of the cooling system that is formed from a winding channel with portions extending in a spanwise direction between the root and a point between the root and the tip and a radially outward serpentine cooling channel of the cooling system that is formed from a winding channel with portions extending in a spanwise direction between the tip and the point between the root and the tip;

a plurality of pin fins extending between the outer wall forming the pressure side and the outer wall forming the suction side in the radially inward serpentine cooling channel; and a plurality of protrusions forming trip strips extending from the outer wall forming the pressure side and from the outer wall forming the suction side in the radially outward serpentine cooling channel.

2. The turbine airfoil of claim 1, wherein the radially inward serpentine cooling channel is a triple pass channel.

3. The turbine airfoil of claim 2, wherein the radially inward serpentine cooling channel includes an inlet at the intersection of the root and the trailing edge and is directed radially inwardly to receive cooling fluids from aspects of the cooling system positioned within the root and includes an outlet at the leading edge.

4. The turbine airfoil of claim 3, wherein a first pass of the radially inward serpentine cooling channel includes a plurality of metering slots positioned in the trailing edge.

5. The turbine airfoil of claim 3, wherein the radially outward serpentine cooling channel includes an inlet in communication with the outlet of the radially inward serpentine cooling channel at the leading edge and includes at least one outlet at the trailing edge to exhaust the cooling fluids.

6. The turbine airfoil of claim 5, wherein the at least one outlet at the trailing edge is formed from a plurality of metering slots positioned in the trailing edge.

7. The turbine airfoil of claim 1, wherein the radially inward serpentine cooling channel and the radially outward serpentine cooling channel are separated from each other by a center rib extending generally chordwise.

8. The turbine airfoil of claim 7, wherein the radially inward serpentine cooling channel is formed from an outward bound first pass, an inward bound second pass, and an outward bound third pass, wherein the first and second passes are separated by a rib extending from the root toward the tip and terminating before reaching the center rib and wherein the second and third passes are separated by a leading edge rib extending spanwise from proximate an intersection between the generally elongated airfoil and the root toward the tip and terminating before reaching the tip.

9. The turbine airfoil of claim 8, wherein the radially outward serpentine cooling channel is formed from an outward bound first pass, an inward bound second pass, and an outward bound third pass, wherein the first and second passes are separated by the leading edge rib and wherein the second and third passes are separated by a rib extending spanwise from the tip inward toward the center rib and terminating before contacting the center rib.

10. A turbine airfoil, comprising:

a generally elongated, hollow airfoil having a leading edge, a trailing edge, a tip at a first end, a root coupled to the airfoil at an end generally opposite to the first end for supporting the airfoil and for coupling the airfoil to a disc, and a cooling system formed from at least one cavity in the elongated, hollow airfoil;

an outer wall forming an outer surface of the generally elongated airfoil;

wherein the cooling system is formed from dual serpentine cooling channels comprising a radially inward serpentine cooling channel of the cooling system that is formed from a winding channel with portions extending in a spanwise direction between the root and a point between the root and the tip and a radially outward serpentine cooling channel of the cooling system that is formed from a winding channel with portions extending in a spanwise direction between the tip and the point between the root and the tip;

wherein the radially inward serpentine cooling channel is a triple pass channel and includes an inlet at the intersection of the root and the trailing edge and is directed radially inwardly to receive cooling fluids from aspects of the cooling system positioned within the root and includes an outlet at the leading edge;

wherein the radially outward serpentine cooling channel includes an inlet in communication with the outlet of the radially inward serpentine cooling channel at the leading edge and includes at least one outlet at the trailing edge to exhaust the cooling fluids;

a plurality of pin fins extending between the outer wall forming the pressure side and the outer wall forming the suction side in the radially inward serpentine cooling channel; and a plurality of protrusions forming trip strips extending from the outer wall forming the pressure side and from the outer wall forming the suction side in the radially outward serpentine cooling channel.

11. The turbine airfoil of claim 10, wherein a first pass of the radially inward serpentine cooling channel includes a plurality of metering slots positioned in the trailing edge.

12. The turbine airfoil of claim 11, wherein the at least one outlet at the trailing edge is formed from a plurality of metering slots positioned in the trailing edge.

13. The turbine airfoil of claim 10, wherein the radially inward serpentine cooling channel and the radially outward serpentine cooling channel are separated from each other by a center rib extending generally chordwise.

14. The turbine airfoil of claim 13, wherein the radially inward serpentine cooling channel is formed from an outward bound first pass, an inward bound second pass, and an outward bound third pass, wherein the first and second passes are separated by a rib extending from the root toward the tip and terminating before reaching the center rib and wherein the second and third passes are separated by a leading edge rib extending spanwise from proximate an intersection between the generally elongated airfoil and the root toward the tip and terminating before reaching the tip.

15. The turbine airfoil of claim 14, wherein the radially outward serpentine cooling channel is formed from an outward bound first pass, an inward bound second pass, and an outward bound third pass, wherein the first and second passes are separated by the leading edge rib and wherein the second and third passes are separated by a rib extending spanwise from the tip inward toward the center rib and terminating before contacting the center rib.

* * * * *